US006446751B1

(12) United States Patent
Ahuja et al.

(10) Patent No.: US 6,446,751 B1
(45) Date of Patent: Sep. 10, 2002

(54) APPARATUS AND METHOD FOR REDUCING NOISE LEVELS

(75) Inventors: Krishan K. Ahuja, Atlanta, GA (US); Mary Lynn G. Azour, Huntsville, AL (US); Jessica L. Shearer, Marietta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 09/655,234

(22) Filed: Sep. 5, 2000

Related U.S. Application Data

(60) Provisional application No. 60/153,774, filed on Sep. 14, 1999.

(51) Int. Cl.[7] ..... E04B 1/82

(52) U.S. Cl. ..... 181/295; 181/280; 181/290; 181/291; 181/30

(58) Field of Search ..... 181/286, 287, 181/290, 291, 293, 294, 295, 296, 30

(56) References Cited

U.S. PATENT DOCUMENTS 4,193,474 A * 3/1980 Okubo et al. ..... 181/287
4,832,147 A * 5/1989 Dear et al. ..... 181/30
4,842,097 A * 6/1989 Woodward et al. ..... 181/290
5,411,623 A * 5/1995 Shutt ..... 181/287

* cited by examiner

*Primary Examiner*—Khanh Dang
(74) *Attorney, Agent, or Firm*—Thomas, Kayden, Horstemeyer & Risley, LLP

(57) ABSTRACT

A flexible sound shielding curtain contains a plurality of sound insulating sheet inserts encased within pockets or otherwise secured on the exterior surfaces of the panels of a curtain. The sound insulating sheet inserts may be constructed of a combination of materials selected and configured such that sound impinging upon the curtain is absorbed or alternatively reflected. The sound shielding curtain can be tuned to insulate an area from a select range of frequencies inherent in select environments. Tuning may be accomplished through the selection and installation of sound insulating sheet inserts configured to reflect or absorb audible acoustical energy. The sound insulating sheet inserts are readily removable to permit periodic laundering of the curtain fabric and to provide adaptability for a number of applications. Sound shielding curtain(s) can be selected, configured, installed, and extended in such a manner as to provide sound reduction in a localized space. The sound shielding curtain(s) may also be configured with a view window by replacing a portion of one or more sound insulating sheets with an acoustically hard transparent material. The acoustically hard material may also comprise a panel of controllable privacy film.

29 Claims, 12 Drawing Sheets

APPARATUS AND METHOD FOR REDUCING NOISE LEVELS

CLAIM OF PRIORITY

This application claims priority to copending U.S. provisional application entitled, "Apparatus and Method for Reducing Noise Levels," having Ser. No. 60/153,774, filed Sep. 14, 1999, which is incorporated herein by reference in its entirety.

The U.S. Government has a paid-up license in this invention and the right in limited circumstances to require the patent owner to license others on reasonable terms as provided for by the terms of Contract No. 508-D85097 awarded by the Veterans Administration.

TECHNICAL FIELD

The present invention is generally related to acoustic isolation and more particularly, is related to an apparatus and method for providing a simple and inexpensive sound shielding curtain for reducing and isolating undesirable sounds.

BACKGROUND OF THE INVENTION

Movable sound barriers presently in use fall into two general categories. These are the rigid panel folding door like arrangements and a more flexible curtain arrangement. The folding door arrangements are typically complex and heavy structures, often employing materials of significant mass to provide sound control. As a result of their complexity and mass, the folding door arrangements are expensive, difficult to install, and do not provide the flexibility required in environments where it is desirable to provide a temporary sound barrier.

Flexible curtain arrangements may be further classified under three general configurations. Some flexible curtain arrangements employ multiple curtains with sound absorbing fillers between them. Other flexible curtain arrangements are constructed of heavy materials in order to accomplish sound absorption. A third group of flexible curtain arrangements consist of a plurality of vertically suspended strips. All three of the flexible curtain configurations are also expensive to make and do not provide for periodic laundering of the curtain material as is required in a number of applications.

SUMMARY OF THE INVENTION

Accordingly, it is an object of the present invention to address the aforementioned deficiencies and inadequacies. The sound shielding curtain of the present invention provides an inexpensive, effective, easily retractable and launderable movable sound barriers. Sound shielding curtains consistent with the present invention may have the outward appearance of a standard curtain, but are capable of shielding noise. Sound insulating curtains of the present invention can be folded to provide temporary storage of the curtain or access to an area, and by adjusting the mass density of their sound insulating sheets, can be used for a range of applications. The sound insulating sheet inserts can be removed from the fabric panel to permit laundering of the fabric panel. In addition, portions of the fabric can be removed to permit integration of an acoustically hard window. The acoustically hard window may comprise a plurality of panels configured to permit curtain retraction. The plurality of window panels may be constructed with 3M Privacy Film to provide controlled transparency.

The present invention provides a flexible, simple, inexpensive, effective and launderable sound absorbing and sound reflective curtain for reducing and isolating undesirable sounds. Briefly described, the sound shielding curtain can be formed from at least one panel of fabric with a plurality of semi-rigid sound insulating sheets attached to the fabric panel(s).

The sound insulating sheets may take the form of a suitably designed panel. The sound insulating sheets may also take the form of an insert. In either form, the sound insulating sheets can be mechanically tuned sound absorbers designed to absorb specific ranges of incident acoustic energy. Sound insulating sheets, in the panel form, may also be constructed from bulk absorbing liner materials, for example, but not limited to, fiberglass, foam, cotton, etc. The sound insulating sheets, in panel form, may be constructed from a combination of bulk and mechanically tuned absorbers.

In accordance with a first embodiment, the sound shielding curtain may be constructed such that the sound insulating sheets are mutually spaced and arranged in a parallel fashion substantially perpendicular to the longitudinal axis of a mount to permit retraction and extension of the curtain in an accordion like fashion. In normal use, the sound shielding curtain is constructed of sufficient length so that the curtain may retain a partially folded configuration throughout its intended application length. In this way, the sound shielding curtain provides an increased surface area for the undesired incident noise to be absorbed.

In a second embodiment, the sound shielding curtain may be constructed with a plurality of pockets attached to at least one surface of the fabric panel(s) with each of the pockets configured to closely receive at least one sound insulating sheet insert.

In accordance with a third embodiment, the sound shielding curtain may be constructed with a plurality of pockets formed by folding a fabric panel and securing the folded panel sections to form a plurality of pockets to bear the weight of at least one sound insulating sheet, the sound insulating sheets further secured to the fabric panel over a portion of their total length via a plurality of ribbons configured to closely receive the exposed remainder of the sound insulating sheets.

In accordance with a fourth embodiment, the sound shielding curtain may be constructed with a plurality of fabric panels configured with snap mechanisms arranged to secure at least one sound insulating sheet configured with a compatible arrangement of snap mechanisms to the surface of the fabric panel.

In a fifth embodiment, the sound shielding curtain may be constructed of a fabric panel folded to form a first panel section and a second panel section. A plurality of strips of hook and loop fastening elements may be mutually spaced to form pockets when the second panel section is substantially aligned and configured with compatible strips of hook and loop fastening elements.

In a sixth embodiment, the sound shielding curtain may be constructed with a plurality of pockets each configured to closely receive at least one sound insulating sheet with each of the pockets secured to the fabric panel(s) such that a portion of each pocket overlaps a pocket secured below in a shingle fashion.

In a seventh embodiment, the sound shielding curtain may comprise an element in a sound insulating system consisting of a sound shielding curtain, a curtain extension, and a valance constructed in accordance with the sound insulating sheets. Another advantage of using the sound shielding curtain of the present invention is that each of the sound shielding curtain embodiments may be augmented with a visually transparent panel to permit visual inspection of an area insulated by the sound shielding curtain.

It is important to note that the sound shielding curtain of the present invention is not limited to vertical orientations. The sound shielding curtain may be added to a room at any distance overhead to provide sound insulation from overhead sources. In this regard, it may be more convenient to arrange the sound shielding sheets within the panels of curtain material in a horizontal rather than a vertical orientation. A horizontal orientation of sound shielding sheets would also allow for temporary storage and or reconfiguration of areas of an enclosed space by retracting the sound curtains on rollers suspended from the ceiling or alternatively, retracting the sound shielding curtain in an accordion like fashion. The sound shielding curtains of the present invention may be suspended from overhead like a banner (in a vertical orientation) or they may be mounted in a multiplicity of orientations responsive to a particular acoustic environment.

The present invention can also be viewed as providing a method for insulating a first area from an undesirable noise source that is adversely affecting a second area. In this regard, the method can be broadly summarized by the following steps. First, providing a mount such that an area is divided into a first sub-area and a second sub-area, the first sub-area subject to an undesired sound. Second, introducing a sound shielding curtain configured to both absorb and reflect undesired frequencies. Last, mounting the sound shielding curtain such that the sound shielding curtain hangs in a plane substantially perpendicular to the undesired sound, to insulate an undesired sound from the second sub-area.

The sound shielding curtain(s) may be applied in a number of environments, by way of example but not limited to, nursing homes, hospitals, homes, offices, vehicle interiors, dormitories, nurseries for children, factories, and other spaces where it may be desirable to insulate an area from one or more undesirable acoustic sources.

Other systems, methods, features, and advantages of the present invention will be apparent to one with skill in the art upon examination of the following drawings and detailed description.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 13A also illustrates a cross-sectional view looking in the direction of lines C—C.

DETAILED DESCRIPTION OF THE PREFERRED EMBODIMENTS

Figure 1:
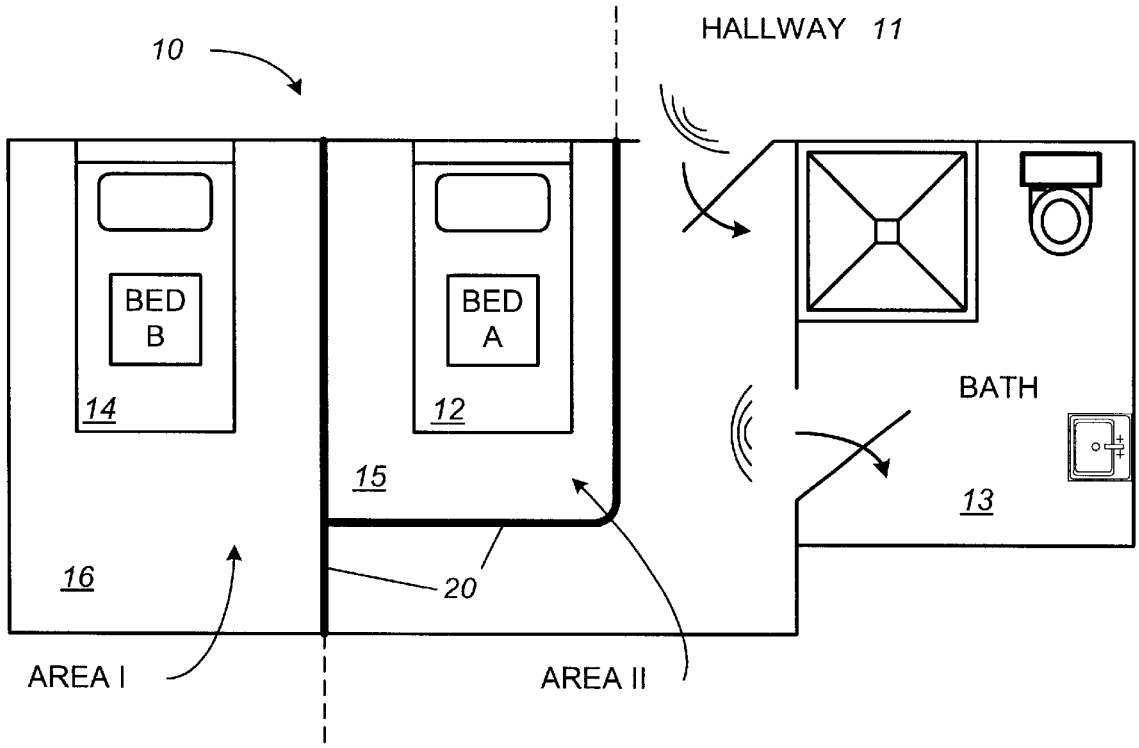
FIG. 1 is a diagram illustrating an overhead view of the layout of a two-bed institutional care room. The diagram illustrates how one or more flexible sound shielding curtains may be placed to create sound insulated areas in sub-portions of the room.
Figure 2:
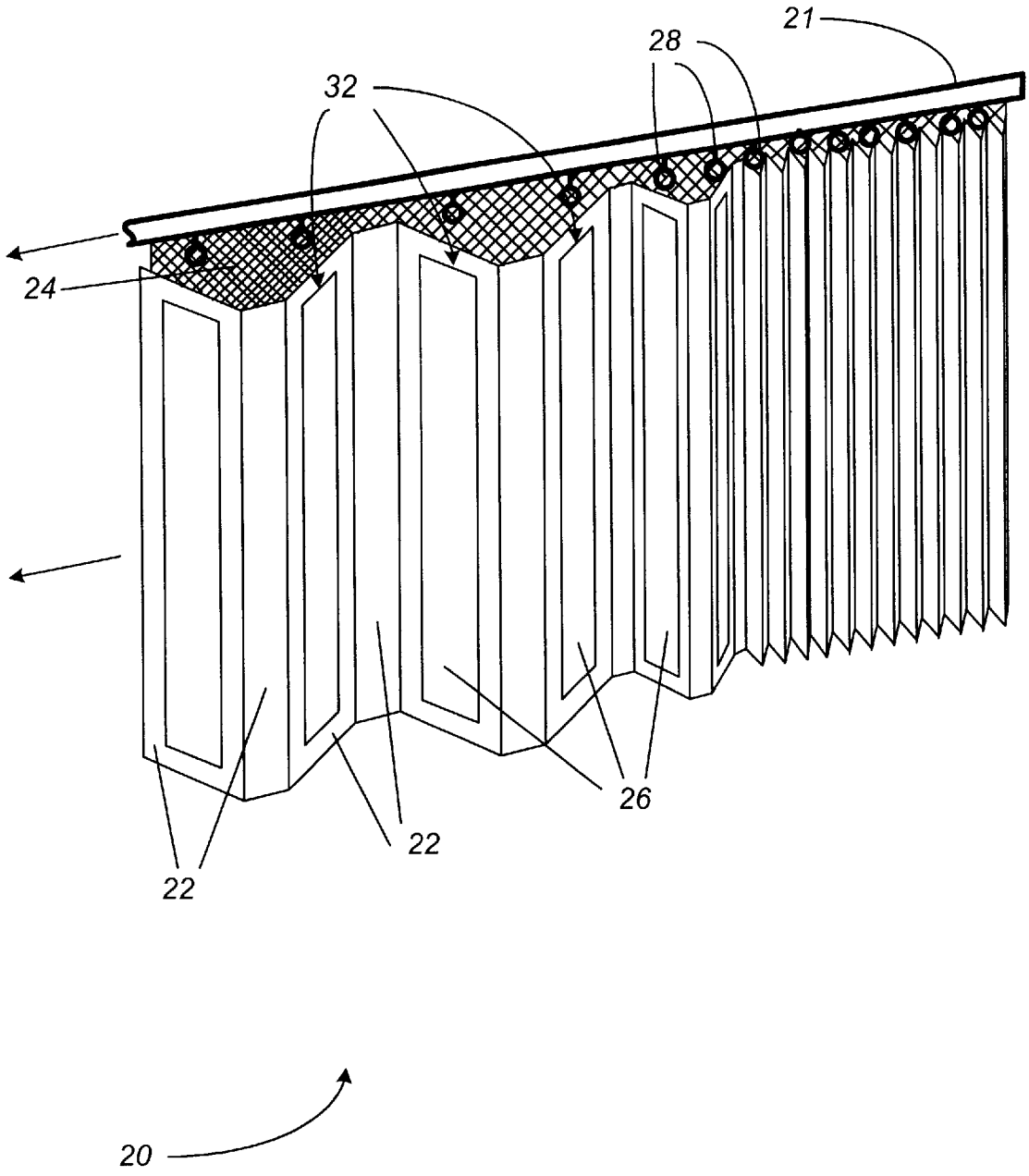
FIG. 2 is a perspective illustration of an embodiment of the sound shielding curtain(s) of FIG. 1.

As shown in FIGS. 1 and 2, one or more sound shielding curtains embodying principles of the present invention may be configured to acoustically partition one or more areas from one or more unintended noise sources. In this regard, FIG. 1 illustrates an overhead view of a two-bed institutional care room. The two-bed institutional care room may be a hospital room 10. FIG. 1 reveals a hospital room 10 bordered by a hallway 11 and defined by four or more walls. The hospital room 10 may consist of a bath 13 and one or more beds 12, 14 (two shown). Both the hallway 11 and the bath 13 are depicted as two unintended noise generating locations.

FIG. 1 further illustrates how two sound shielding curtains 20 may be configured in concert with the walls of hospital room 10 to effectively separate the hospital room 10 into noise shielded area I 16 and noise shielded area II 15. In this manner, noise shielded area I surrounding bed B 14 and noise shielded area II 15 surrounding bed A 12 are insulated from the unintended noise generated either in hallway 11 or in bath 13. The configuration of the sound shielding curtains 20 in FIG. 1 also serves to acoustically insulate each of area I 16 and area II 15 from one another. It is important to note that the physical layout of the sound shielding curtains 20 in FIG. 1 is but one example of a configuration that would effectively insulate area I 16 and area II 15 from both unintended noise sources and each other.

Having described one environment where one or more sound shielding curtain(s) may be utilized to acoustically insulate one or more areas from one another and from an unintended noise source in FIG. 1, reference is now directed to FIG. 2. FIG. 2 is a perspective illustration of an embodiment of the sound shielding curtain(s) 20 introduced in FIG. 1.

The sound shielding curtain 20 may be constructed of one or more fabric panel(s) 22 with a plurality of pockets 26 fixed to the surface(s) of the fabric panel(s) 22. Each of the pockets 26 may be configured to closely accept at least one sound insulating sheet insert 32. The sound shielding curtain 20 may further comprise a mounting interface fixed along one or more edges of the fabric panel(s) 22. The mounting interface of the sound shielding curtain 20 may be mesh 24 constructed of a material with sufficient strength and durability to support the sound shielding curtain 20. A plurality of grommets 28 may also be added to the mounting portion of the sound shielding curtain 20 to permit installation and removal of the sound shielding curtain 20 along a mount 21. The mount 21 may comprise, but is not limited to, a track, a rod, or any of a number of configurations capable of supporting the sound shielding curtain 20. It is important to note that the mount 21 may be integrated with any of a number of motorized or non-motorized mechanical assemblies configured to enable or assist curtain extension and retraction. Mount 21 may further comprise one or more fasteners capable of interfacing with the fabric panel(s) 22 of a sound shielding curtain 20.

FIG. 2 exemplifies a configuration capable of supporting a sound shielding curtain 20 for the purpose of illustration. Other combinations and methods of support that permit retraction and extension of the sound shielding curtain 20 are within the scope of the present invention.

In accordance with a preferred embodiment, the sound shielding curtain may be constructed such that the pockets 26 surrounding the sound insulating sheet inserts 32 are spaced and arranged in a parallel fashion substantially perpendicular to the longitudinal axis of the mount 21 to permit retraction and extension of the curtain in an accordion like fashion. Physical arrangements of the fabric panel 22, the pockets 26, and the sound insulating sheet inserts 32 that permit the accordion like folding of the sound shielding curtain 20 become important in environments such as the hospital room 10 shown in FIG. 1. In institutional care facilities such as the hospital room 10, it is important for the sound shielding curtain(s) 20 to be readily extended and retracted along the longitudinal axis of the mount 21 as is illustrated in FIG. 2 to permit access and egress to and from the areas defined by a fully extended sound shielding curtain 20.

The material used to construct the one or more sound insulating sheet inserts 32 surrounded by the fabric panel 22 and the pockets 26 may be varied in response to the nature of noise one needs to shield and the amount of noise reduction that is desired. For most applications in nursing homes, hospitals, and offices, ⅛ inch thick plastic sound insulating sheets may provide from 10 to 12 dB of sound shielding. However, in environments where industrial noise of a significantly greater magnitude need to be controlled, thicker sheets made out of denser material may be desirable. Industrial application sound shielding curtains 20, because of their increased weight, may be difficult to extend and retract. In applications where weight of the sound shielding curtain 20 becomes a factor, similar results can be obtained by using two or more layers of curtains constructed in accordance with concepts of the present invention.

In some cases, the sound shielding curtains 20 can be quite heavy. A cart configured with a movable platform may be used to support the weight of a sound shielding curtain 20 while each of the curtain fasteners is disconnected from the mount 21. The cart may be provided with a platform that stores horizontally, but can be made to stand vertically by way of a pivot or hinge in order to promote ease of installation and removal of heavy sound shielding curtains. Straps configured with snaps may be further integrated with the moveable platform in order to fasten the folded curtain to the platform when the platform is in other than a horizontal position. The straps may support the sound shielding curtain 20 while it is being disconnected from the mount 21. After each of the plurality of grommets 28 is disconnected from the mount 21, the curtain may then be moved from its substantially vertical position along with the platform to a horizontal position on the cart. The heavy curtain may then be transported to another location for subsequent reinstallation and or for laundering (after removal of the sound insulating sheets) using the cart. It will be apparent to those skilled in the art that the cart and platform assembly may have to be counterbalanced in order to provide stable support of the sound shielding curtain 20 when the platform and curtain are in other than a horizontal position.

Figure 3A:
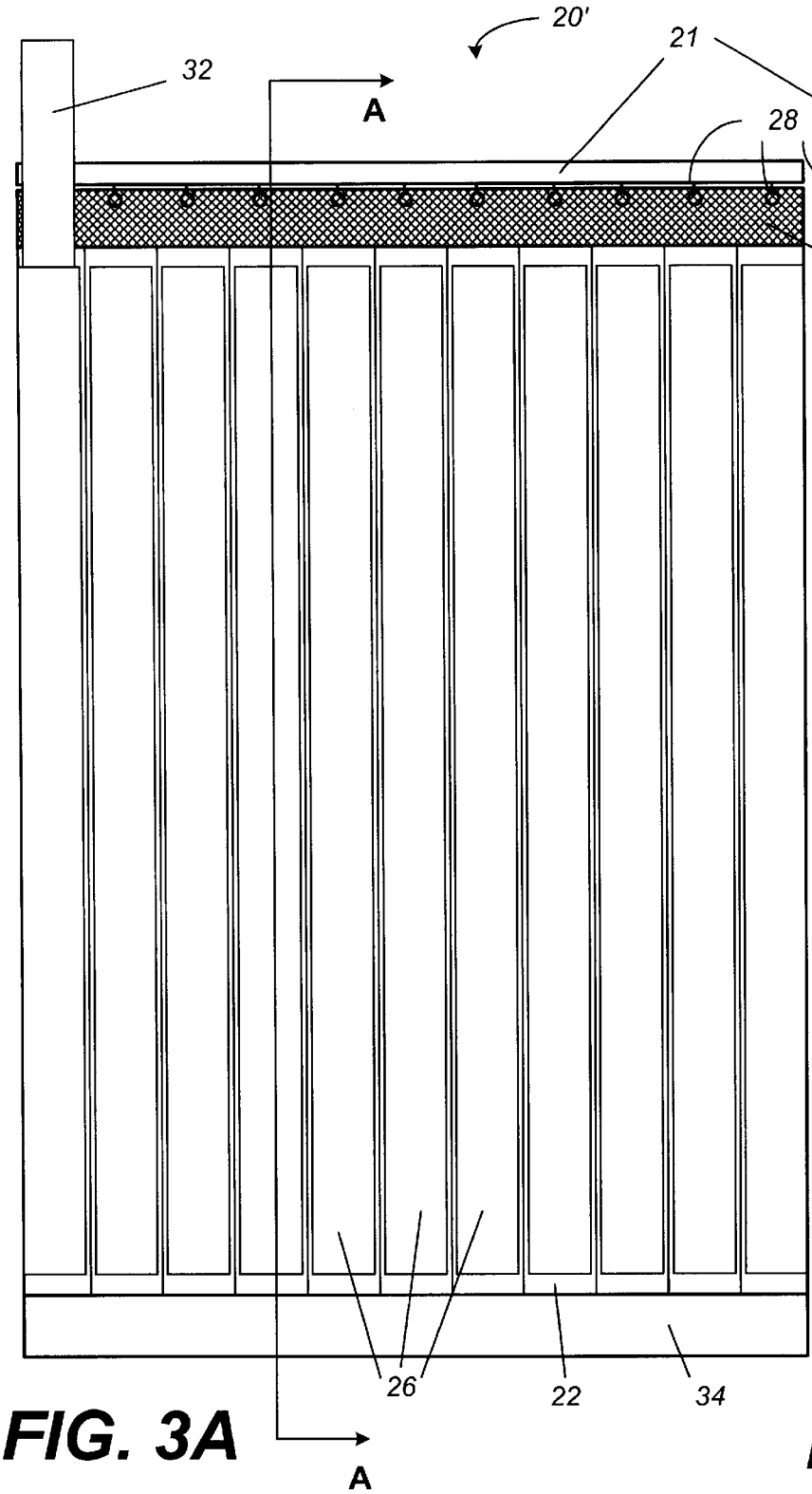
FIG. 3A is a portion of the front view of the fully extended sound shielding curtain of FIG. 2.
Figure 3B:
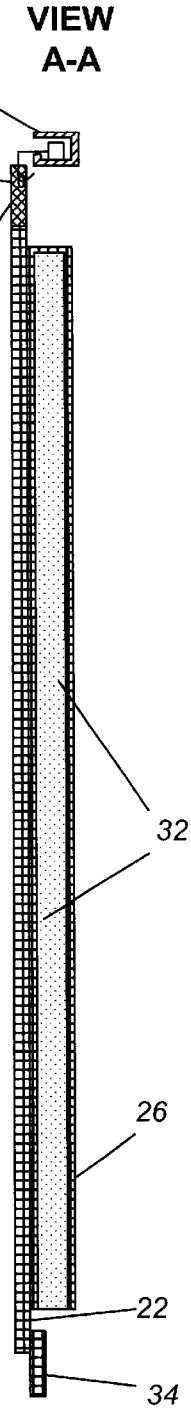
FIG. 3B is a cross-sectional view of the sound shielding curtain of FIG. 3A looking in the direction of lines A—A.

Having introduced one embodiment and possible environments where one or more sound shielding curtain(s) 20 may be introduced to acoustically insulate one or more areas from unintended noise sources in FIGS. 1 and 2, reference is now directed to FIGS. 3A and 3B. In this regard, FIG. 3A is a portion of the front view of the fully extended sound shielding curtain 20 of FIG. 2. FIG. 3B is a cross-sectional view of the sound shielding curtain 20' of FIG. 3A looking in the direction of lines A—A.

As shown in FIG. 3A, the sound shielding curtain 20' may be constructed of a fabric panel 22, mesh 24, a plurality of pockets 26, a plurality of grommets 28 located within the mesh 24, a plurality of sound insulating sheet inserts 32, and an extension 34. As previously described in association with FIG. 2, the plurality of pockets 26 fixed to the surface of the fabric panel 22 may be configured to closely accept at least one sound insulating sheet insert 32. As shown in FIG. 3A, each of the pockets 26 may be fixed to the fabric panel 22 such that one or more sound insulating sheet insert(s) 32 may be inserted in an opening created by the pocket 26 and the fabric panel 22. As further shown in FIG. 3A, an extension 34 may be added to the edge of the fabric panel 22 opposite the mount 21 to permit the sound shielding curtain 20' to contact the floor along the entire length of an area defined by the sound shielding curtain 20'. The addition of the extension 34 provides for a more effective acoustic barrier between an insulated area and an unintended noise source.

Here, mount 21 is depicted as a channel configured to receive a plurality of rollers. Each of the rollers may be configured with a hook mechanism capable of interfacing with the grommets 28. View A—A illustrated in FIG. 3B reveals a possible configuration of mount 21 in cooperation with the sound shielding curtain 20'. FIG. 3B shows a fabric panel 22, mesh 24, grommet 28, mount 21, extension 34, pocket 26, and sound insulating sheet insert 32 as viewed in the direction of line A—A.

Figure 4A:
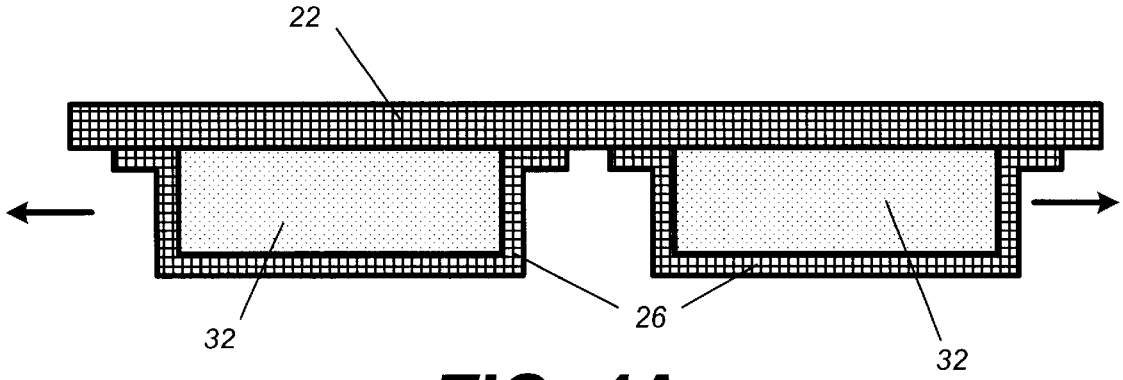
FIG. 4A is a cross-sectional view (vertical) of a portion of a sound shielding curtain constructed in accordance with the present invention.
Figure 4B:
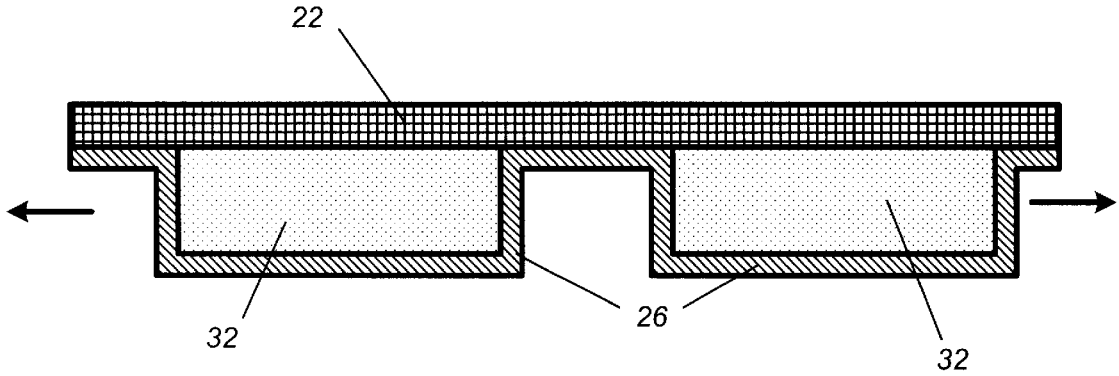
FIG. 4B is a second cross-sectional view (vertical) of a portion of a sound shielding curtain constructed in accordance with the present invention.

Having further described a sound shielding curtain 20' consistent with the present invention with regards to FIGS. 3A and 3B, reference is now directed to FIGS. 4A and 4B. In this regard, FIG. 4A is a cross-sectional top view of a portion of a sound shielding curtain 20' constructed in accordance with the present invention. FIG. 4B is a second cross-sectional top view of a portion of a sound shielding curtain 20' also constructed in accordance with the present invention.

The cross-sectional view illustrated in FIG. 4A, shows two pockets 26 constructed of the same material as that used for the fabric panel 22. FIG. 4A further illustrates that each of the two pockets 26 may be constructed separately, that is, each is constructed of its own panel of fabric. FIG. 4A further illustrates the close relationship between each of the pockets 26 and the respective sound insulating sheet insert 32 that the pocket 26 surrounds.

Similarly, the cross-sectional view illustrated in FIG. 4B, reveals two pockets 26 fixed to the fabric panel 22 to form spaces for closely receiving at least one sound insulating sheet insert(s) 32. However, the pockets 26 of FIG. 4B differ from those shown in 4A in that they are constructed of a single panel of a fabric dissimilar to that used for the fabric panel 22.

The two examples of constructing pockets 26 for receiving sound insulating sheet inserts 32 are offered to illustrate the concepts associated with construction of a sound shielding curtain 20' consistent with the present invention. It will be readily apparent to those skilled in the art that other configurations may be used consistent with the present invention. For example, a first portion of a sound shielding curtain 20' may be constructed using the arrangement illustrated in FIG. 4A. A second portion of the same sound shielding curtain 20' may be constructed using the arrangement illustrated in FIG. 4B. In another variation, one may construct the sound shielding curtain 20' whereby both construction arrangements are alternated as one traverses the sound shielding curtain 20'.

Having described two alternatives for constructing the pockets 26 on a fabric panel 22 consistent with the present invention, reference is now directed to FIGS. 5 through 8, which reveal top views of possible orientations of the pockets 26 together with the sound insulating sheet inserts 32 in relation to a fabric panel 22 consistent with the sound shielding curtain of FIG. 2. Although FIGS. 2, 3A, 3B, 4A, and 4B have shown the pockets 26 configured to closely receive the sound insulating sheet inserts 32 fixed to one side of a fabric panel 22, it will be readily appreciated that a host of other arrangements are possible. Some exemplary configurations are illustrated in FIGS. 5 through 8.

Figure 5:
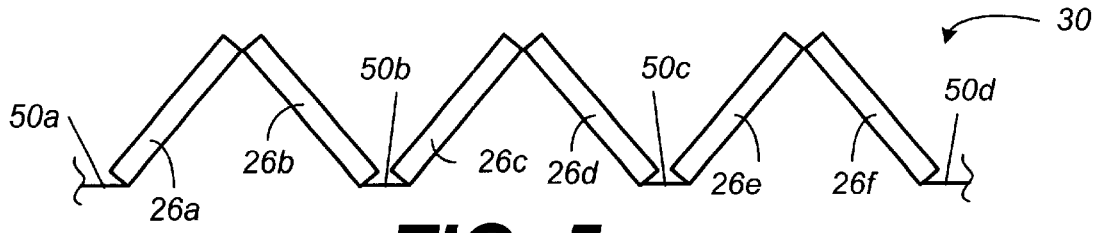
FIGS. 5–8 illustrate cross-sectional views focusing on various arrangements between sound insulating sheets and fabric panels of the sound shielding curtain of FIG. 2.

In FIG. 5, a portion of a fabric panel and pocket arrangement 30 suitable for constructing a sound shielding curtain 20 of FIG. 2 is illustrated from a top view. The physical arrangement illustrated in FIG. 5 may consist of pockets 26*a*–26*f* attached on the same surface of one or more connecting fabric panel portions 50*a*–50*d*. It is readily apparent that the connecting fabric panel portions 50*a*–50*d* may be constructed from a single panel of fabric with the connecting fabric panel portions 50*a*–50*d* providing connective support between the individual pockets 26*a*–26*f*. It is significant to note that in addition to supporting the pockets 26*a*–26*f*, the fabric panel portions 50*a*–50*d*, may be constructed of a sufficient length to permit folding of the individual pockets 26*a*–26*f* one over the other when the sound shielding curtain 30 is retracted. Because each of the pockets 26*a*–26*f* are attached on the same side of the fabric panel and pocket arrangement 30, connecting fabric panel portions may be omitted along alternate connecting locations across the entire width of the fabric panel and pocket arrangement 30 as shown in FIG. 5.

Figure 6:
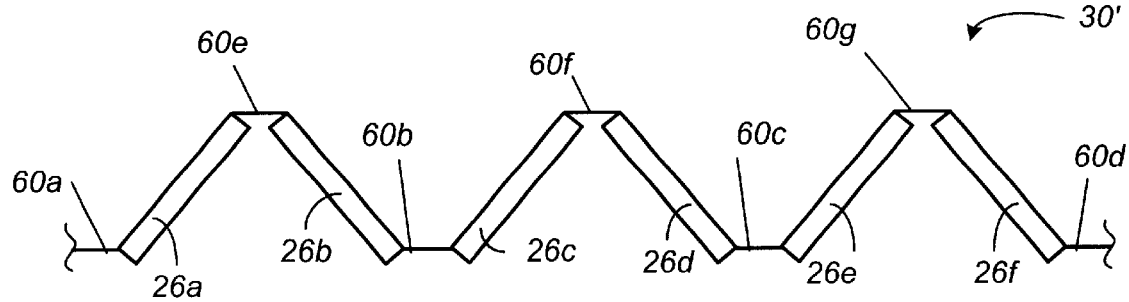

Having described a possible configuration of a fabric panel and pocket arrangement 30 in FIG. 5, reference is now directed to FIG. 6. In FIG. 6, a portion of a fabric panel and pocket arrangement 30' suitable for constructing a sound shielding curtain 20 of FIG. 2 is illustrated from a top view. The physical arrangement illustrated in FIG. 6 may comprise of pockets 26*a*–26*f* attached on the same surface of one or more connecting fabric panel portions 60*a*–60*g*. It is readily apparent from the illustration of FIG. 6, that the connecting fabric panel portions 60*a*–60*g* may be constructed from a single panel of fabric with the connecting fabric panel portions 60*a*–60*g* providing connective support between the individual pockets 26*a*–26*f*. It is significant to note that in addition to supporting the pockets 26*a*–26*f*, the fabric panel portions 60*a*–60*g*, may be constructed of a sufficient length to permit folding of the individual pockets 26*a*–26*f* one over the other when the sound shielding curtain 30' is retracted. Although the fabric panel portions 60*a*–60*g*, illustrated in FIG. 6 are illustrated in an equidistant configuration, the only limitation on length is a minimum fixed by the sum of the width of any two adjacent pockets. As by way of example, adjacent pocket pairs 26*a* and 26*b*; 26*c* and 26*d*; and 26*e* and 26*f* may fold over each other when the panel and pocket arrangement 30' is retracted if the length of fabric panel portions 60*e*, 60*f*, and 60*g* is greater than the sum of the widths of the respective pocket pair connected by each individual portion.

Figure 7:
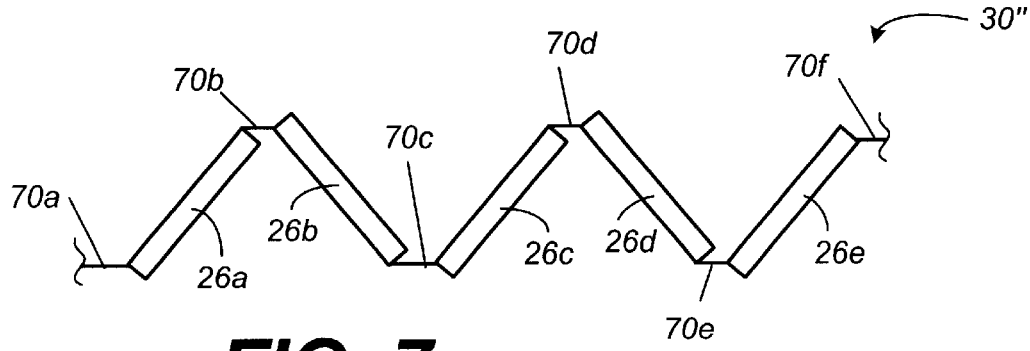

Having described a possible configuration of a fabric panel and pocket arrangement 30' in FIG. 6, reference is now directed to FIG. 7. In FIG. 7, a portion of a fabric panel and pocket arrangement 30" suitable for constructing a sound shielding curtain 20 of FIG. 2 is illustrated from a top view. The physical arrangement illustrated in FIG. 7 may comprise pockets 26*a*–26*e* attached on alternating surfaces of one or more connecting fabric panel portions 70*a*–70*f*. As shown in FIG. 7, the connecting fabric panel portions 70*a*–70*f* may be constructed from a single panel of fabric with the connecting fabric panel portions 70*a*–70*f* providing connective support between the individual pockets 26*a*–26*e*. It is significant to note that in addition to supporting the pockets 26*a*–26*e*, the fabric panel portions 70*a*–70*f*, may be constructed of a sufficient length to permit folding of the individual pockets 26*a*–26*e* one over the other when the sound shielding curtain 30" is retracted. Although the fabric panel portions 70*a*–70*f* are illustrated in an equidistant configuration, the only limitation on length is a minimum fixed by the sum of the width of one of the adjacent pockets. As by way of example, fabric panel portion 70*a* must be of a length equal to or greater than the width of pocket 26*a* to permit pockets 26*a* and 26*b* to fold over each other when the panel and pocket arrangement 30" is retracted.

Figure 8:
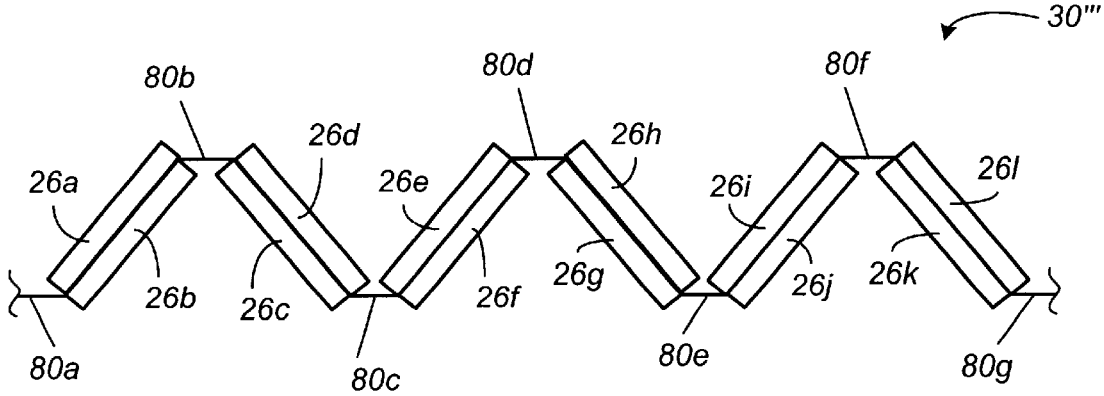

Having described a possible configuration of a fabric panel and pocket arrangement 30" in FIG. 7, reference is now directed to FIG. 8. In FIG. 8, a portion of a fabric panel and pocket arrangement 30'" suitable for constructing a sound shielding curtain 20 of FIG. 2 is illustrated from a top view. The physical arrangement illustrated in FIG. 8 may comprise pockets 26*a*–26*l*. Here, the pockets 26 are attached on both surfaces of a fabric panel 22. The fabric panel and pocket arrangement 30'" may further be constructed with a plurality of connecting fabric panel portions 80*a*–80*g*. As shown in FIG. 8, the connecting fabric panel portions 80*a*–80*g*, may be constructed from a single panel of fabric with the connecting fabric panel portions 80 providing connective support between the individual pockets 26*a*–26*l*. It is significant to note that in addition to supporting the pockets 26*a*–26*l*, the fabric panel portions 80, may be constructed of a sufficient length to permit folding of the individual pockets 26*a*–26*l* to fold one over the other when the sound shielding curtain 30'" is retracted. Although the fabric panel portions 80*a*–80*g* are illustrated in an equidistant configuration, the only limitation on length is a minimum fixed by the sum of the width of two adjacent pockets 26. As by way of example, fabric panel portion 80*b* must be of a length equal to or greater than the sum of the widths of pockets 26*b* and 26*c* to permit pockets 26*b* and 26*c* to fold over each other when the panel and pocket arrangement 30'" is retracted.

Figure 9:
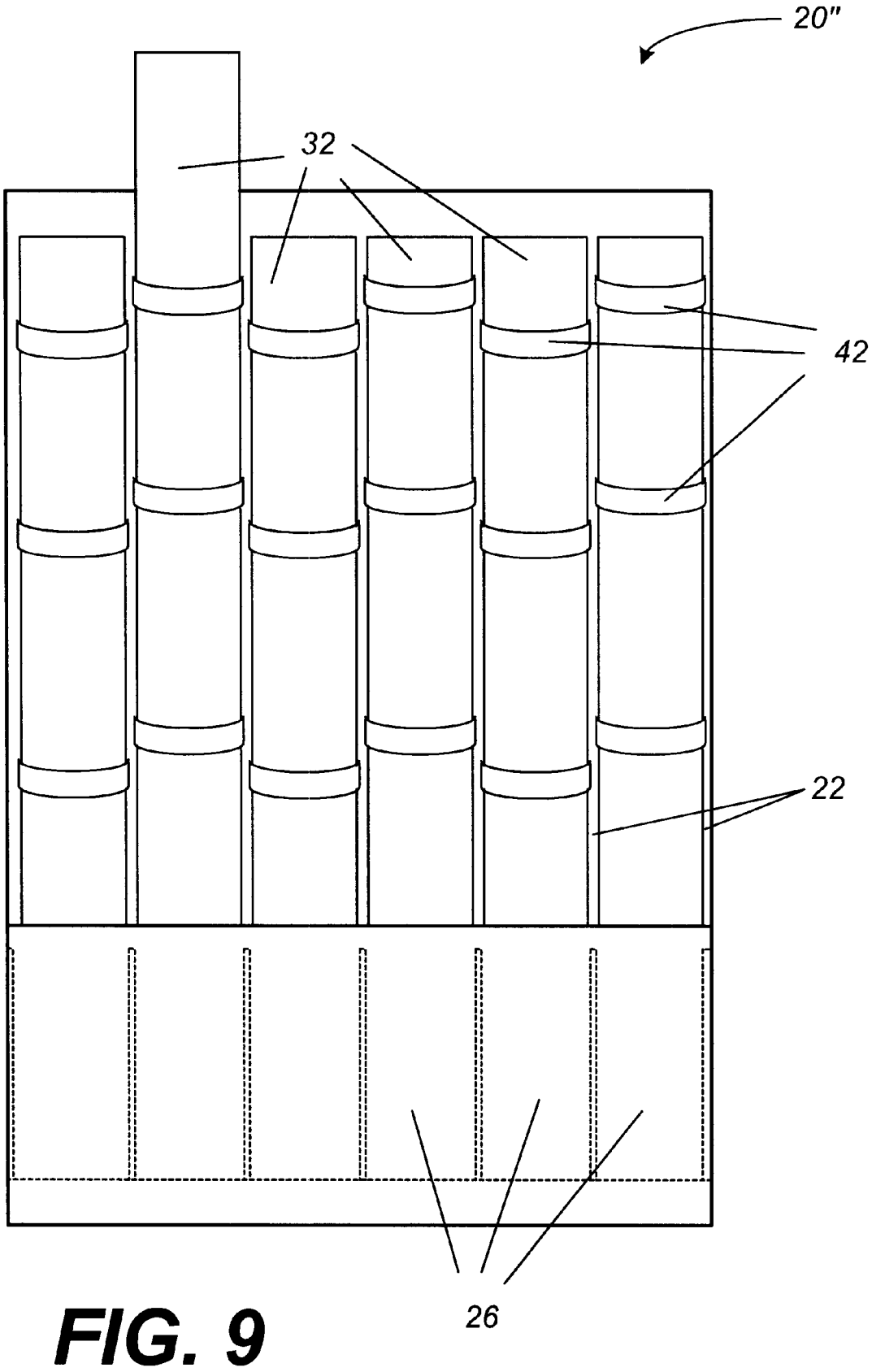
FIG. 9 illustrates a front view of a portion of a sound shielding curtain constructed in accordance with the present invention.

Having described several possible arrangements of pockets 26 associated with the sound shielding curtain 20 of FIG. 2 in FIGS. 5–8, reference is now directed to FIG. 9. In this regard, FIG. 9 illustrates a front view of a portion of a sound shielding curtain 20" constructed in accordance with the present invention.

A portion of a sound shielding curtain 20" may be constructed of a fabric panel 22, a plurality of pockets 26, a plurality of sleeves 42, and a plurality of sound insulating sheet inserts 32. The sound shielding curtain 20" may be arranged as follows. Fabric panel 22 may be folded along the lower edge to provide a flap of material from which to construct a plurality of pockets 26 as shown in FIG. 9. The plurality of pockets 26, configured to closely receive one or more sound insulating sheet inserts 32, may be formed by forming seams in the flap of material. The pockets 26 formed through practicing this method may then support the weight of the one or more sound insulating sheet inserts surrounded in each of the pockets. Sleeves 42 may be added to the frontward facing exterior surface of the fabric panel 22 to further support those portions of the one or more sound insulating sheet inserts 32 not enclosed within the pockets 26.

Figure 10:
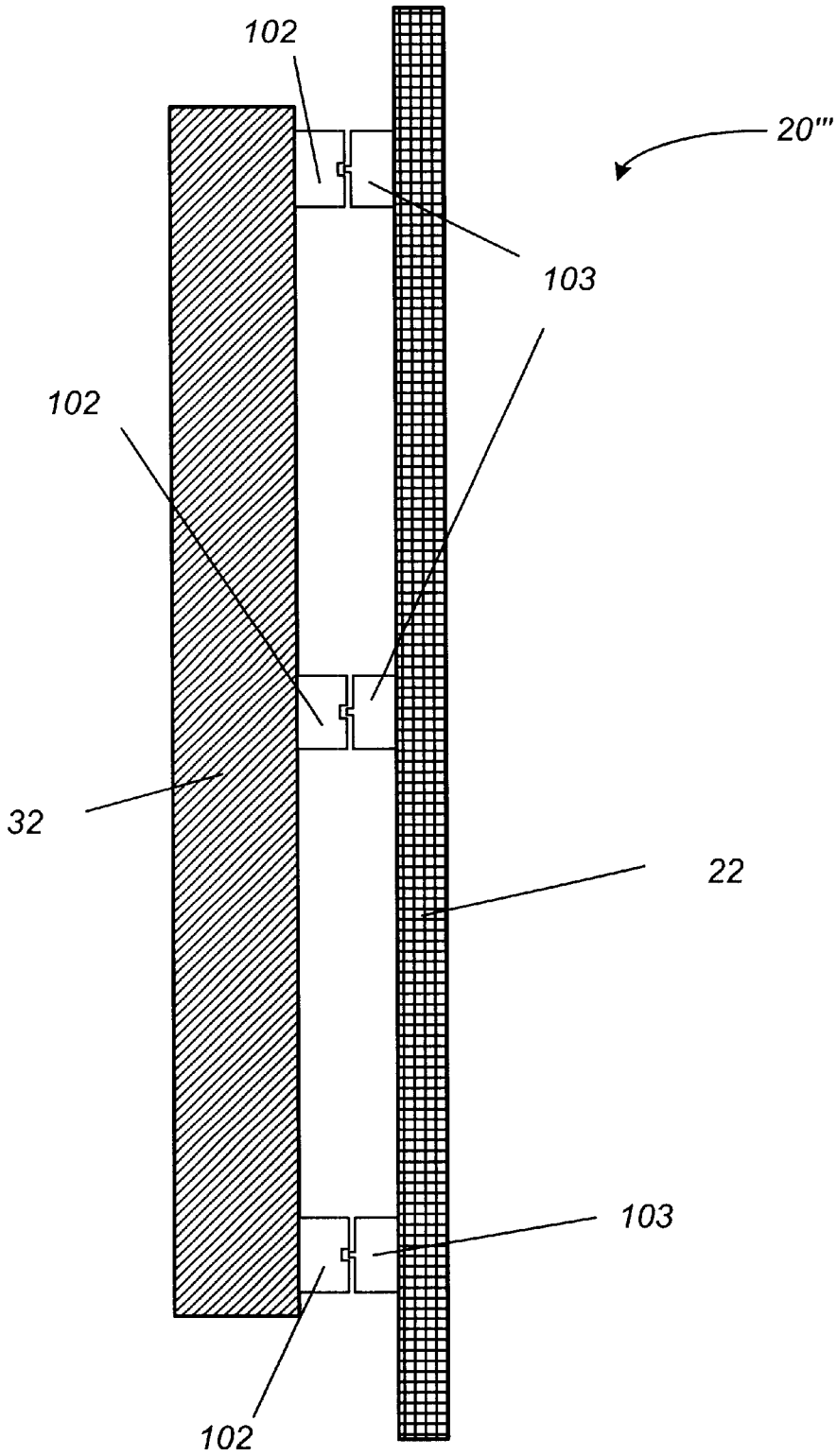
FIG. 10 is a cross-sectional view illustrating a mechanism for securing a sound insulating sheet to a surface of a fabric panel.

Having described a possible configuration of a sound shielding curtain 20" constructed in accordance with the present invention with regards to FIG. 9, reference is now directed to FIG. 10. In this regard, FIG. 10 is a cross-sectional view illustrating a mechanism for securing a sound insulating sheet (in panel form) to a fabric panel surface.

FIG. 10 reveals a portion of a sound shielding curtain 20'" constructed by temporarily attaching one or more sound insulating sheet inserts 32 to the surface of a fabric panel 22. In this regard, FIG. 10 shows a plurality of snap mechanisms 103 permanently affixed to an exterior surface of fabric panel 22. FIG. 10 further shows a plurality of snap mechanisms 102 permanently affixed to an exterior surface of a sound insulating sheet insert 32 arranged in such a manner as to mate with snap mechanisms 103. It is significant to note that the arrangement of individual snap mechanism pairs illustrated in FIG. 10 are by way of example only. It will be readily appreciated by those skilled in the art that the arrangement of snap mechanisms as shown may be adjusted to swap both the mounting location and or the type of snap mechanism 102, 103 fixed to either the fabric panel 22 and or the sound insulating sheet insert 32. The only limitation is that the snap mechanisms 102, 103 align spatially along both the exterior surface of the fabric panel 22 and the sound insulating sheet insert 32.

Figure 11A:
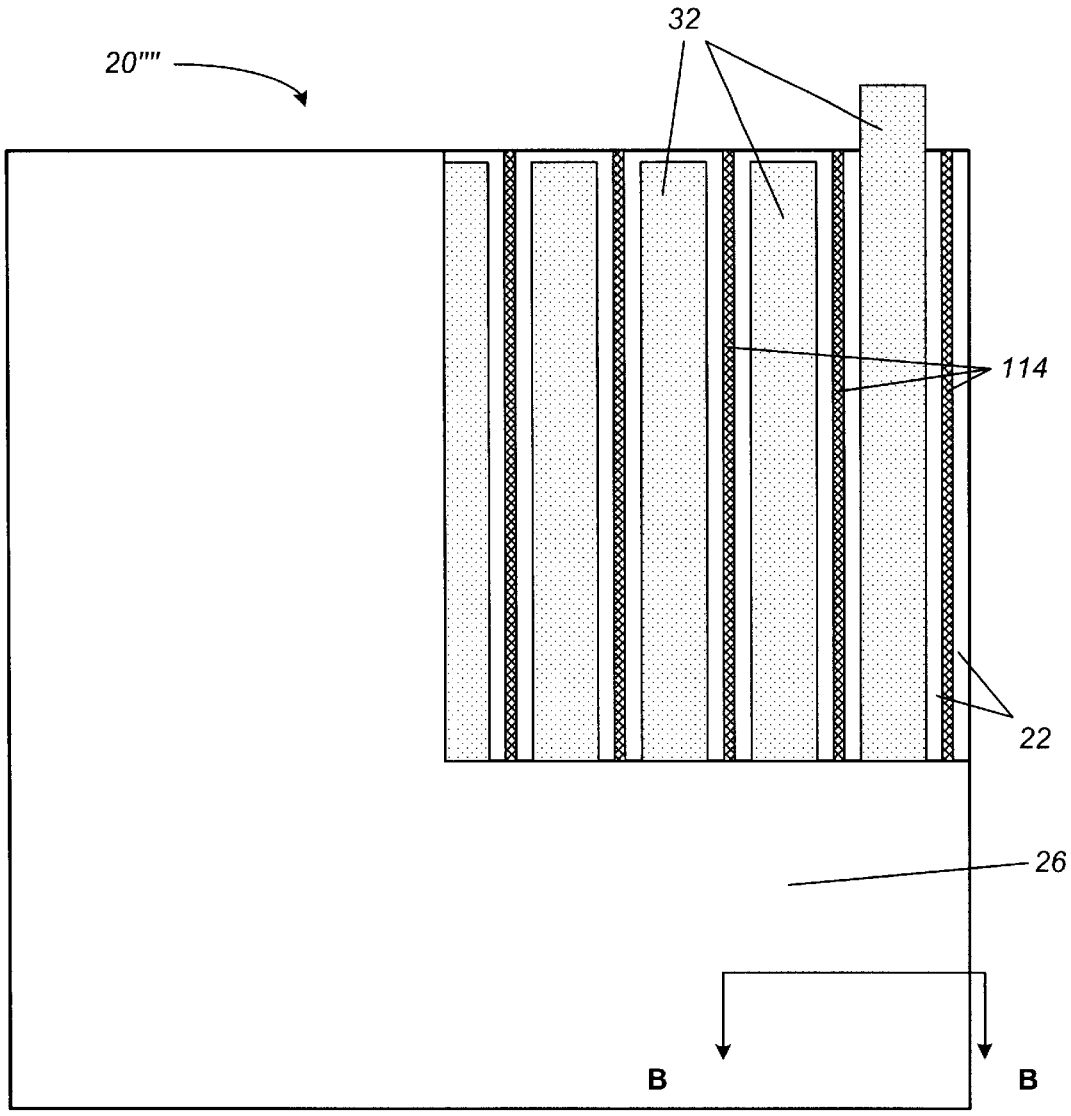
FIG. 11A is a front view of a sound shielding curtain constructed in accordance with the present invention.
Figure 11B:
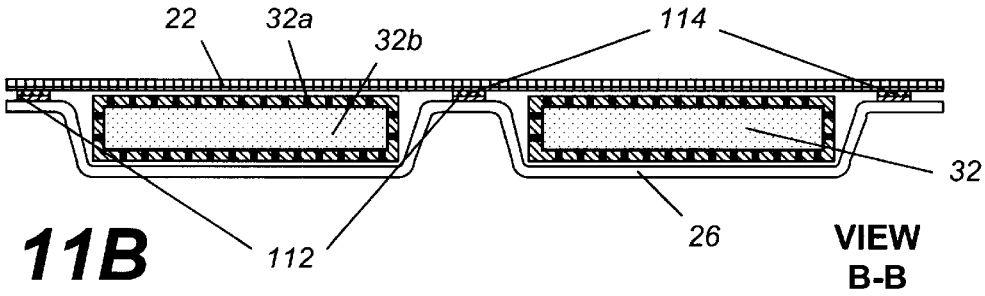
FIG. 11B is a cross-sectional view looking in the direction of lines B—B.

Having described another possible method for constructing a sound shielding curtain 20'" consistent with the present invention as illustrated in FIG. 10, reference is now directed to FIGS. 11A and 11B. FIGS. 11A and 11B illustrate another possible embodiment of a sound shielding curtain 20"" consistent with the present invention. FIG. 11A is a front view of a sound shielding curtain 20"" constructed with multiple panels of fabric. FIG. 11B is a cross-sectional view looking in the direction of lines B—B.

A sound shielding curtain 20"" may be constructed with a plurality of hook and loop fastener strips 114 permanently fixed to the front surface of fabric panel 22. The plurality of hook and loop fastening strips 114 may be configured in a substantially vertical and parallel arrangement so as to form the sides and the bottom edge of a plurality of pockets 26 formed when a second fabric panel configured with similarly arranged hook and loop fasteners 112 (see FIG. 11B) is brought into contact with the front surface of fabric panel 22. The second panel of fabric may be selected for aesthetics and for additional sound absorption. The sound shielding curtain 20"" may be configured by lying the fabric panel 22 on a large horizontal surface, placing the plurality of sound insulating sheet inserts 32 between the rows formed by the plurality of hook and loop fastening strips 114, and placing a panel of fibric configured in substantially the same arrangement so that the hook and loop fastening strips 114 and 112 engage one another. It is significant to note that the separation between vertical rows of hook and loop fastening strips 112 on the panel of fabric used to form the pockets 26 will have to accommodate the width of the one or more sound insulating sheet inserts 32 intended to be closely received in the space between fabric panels.

The construction method illustrated in FIG . 11A and 11B is but one example of many combinations of configurations consistent with the present invention. For example, either or both hook and loop fastening strips 114, and 112 may be interchanged in any number of combinations. In addition, either or both of the plurality of hook and loop fastening strips 114, and 112 may be staggered or interrupted across the surfaces of the fabric panel 22 and the pocket 26 forming panel of material. The hook and loop fastening strips 114, 112 must be capable of supporting the sound insulating sheet inserts 32 together with the weight of the pocket 26 fabric and they must be configured to permit the substantially vertical insertion of the one or more sound insulating sheet inserts 32 in the pocket 26 created between the fabric panel 22 and the pocket 26 panel.

In addition to highlighting that the fabric panel used to form the plurality of pockets 26 may be constructed of a material different than that of fabric panel 22, FIG. 11 reveals some important features of the sound insulating sheet inserts 32. In this regard, an important feature of the invention lies in the materials selected and in the construction of the sound insulating sheet inserts 32. The sound insulating sheet inserts 32 can be constructed such that they absorb, and in the alternative, reflect a range of incident sound frequencies. The sound insulating sheet inserts 32 can be constructed of exterior materials that make the sheets semi-rigid while retaining the flexibility required to permit easy removal and insertion within the pocket(s) 26.

The sound insulating sheet inserts 32 may be "tuned" by selecting appropriate materials and alternating layers of the materials selected in a sandwich like fashion. A cross-sectional view of a sound insulating sheet insert 32 might reveal a first layer consisting of a semi-rigid but flexible composite sheet, a middle layer of polyurethane or other sound absorbing foam, and another layer consisting of a flexible composite sheet. FIG. 11B reveals a cross-sectional view of a possible configuration of a two-material sound insulating sheet insert 32. In this regard, FIG. 11B illustrates a sound insulating sheet insert 32 having a single perforated outer layer 32*a* surrounding an inner layer 32*b* of a separate material. It is important to note that outer layer 32*a* may be configured with a plurality of holes suitable to support inner layer 32*b* while permitting incident acoustic energy to penetrate to the inner layer 32*b*.

In another embodiment, a sound insulating sheet insert 32 can be constructed of a first solid sheet configured in accordance with the outer layer 32*a* of FIG. 11B, a middle layer of loose beads or other particles, with another solid sheet or a perforated sheet of a similar or dissimilar material than that of the first layer introduced within the loose beads or particles. In a similar fashion, the sound insulating sheet inserts 32 may be constructed of a multiplicity of layers of alternating materials of different densities and sound absorbing structures. For example, the aforementioned beads, could be hollow and constructed of a low density plastic. The beads may also be configured with or without pores through their surface. The particles, mentioned above could be constructed of perlite. The foam interior layer of the sandwich structure introduced above, could be constructed of foam formed to loosely fill the space between one or more perforated materials. It is important to note that the arrangement illustrated in FIGS. 11A and 11B is not limited to sound insulating sheets constructed in a layered manner. Not only could the sound insulating sheets be constructed of a single material, they may be replaced by a mechanically tuned sound insulating sheet.

Figure 12:
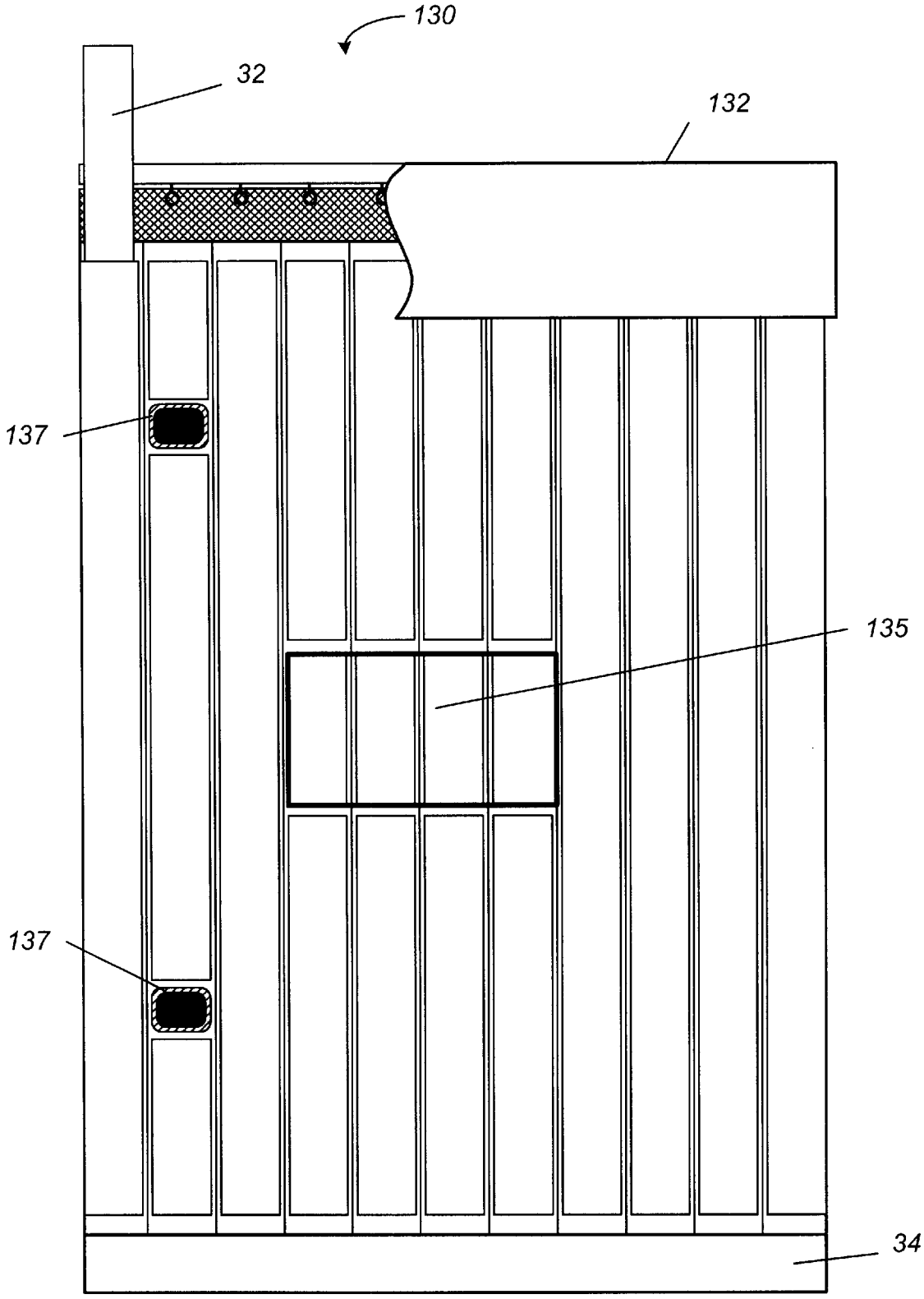
FIG. 12 is a front view of a sound shielding curtain system illustrating the curtain of FIG. 3A with a valance and a curtain extension.

Having described an embodiment of a sound shielding curtain 20"" as illustrated in FIGS. 11A and 11B, reference is now directed to FIG. 12, which illustrates a sound shielding curtain assembly 130 consistent with the present invention. In this regard, FIG. 12 is a front view of a sound shielding curtain assembly 130 with a valance, an extension, at least one ventilation port, and a viewing window.

A sound shielding curtain assembly 130 may comprise a sound shielding curtain consistent with the teachings of the present invention, as well as, a valance 132, a viewing window 135, a ventilation port 137, and an extension 34. It is important to note that where it is not possible to arrange a single sound shielding curtain assembly 130 from ceiling to floor, the curtain assembly may be divided into two or more portions. The main curtain can be attached down to the floor using standard supports such as from a curtain rod or a mounting track previously shown. A valance 132 can be added between the ceiling and just below the upper edge of the curtain built along the principles of the sound shielding curtain 20 described here. The valance 132 can stay fixed in place across the width of the curtain. This will allow drawing and withdrawing of the curtain without moving the valance 132. Note that the valance 132 may be adapted to the physical constraints of a room. It may be permanently fixed to the ceiling or to the sound shielding curtain's mount 21. In a preferred embodiment, maximum sound shielding may be obtained when the inner edges of the valance 132 and the outer edges of the fabric panel 22 on both sides are nearly touching.

As illustrated in FIG. 12, a valance 132 constructed in accordance with the sound insulating sheet inserts 32 of the present invention can be constructed and mounted to overlap that portion of a sound shielding curtain 22 substantially comprising the interface with the mount 21 (herein illustrated as grommets 28 integrated within mesh 24 between the sound shielding curtain 22 and the mount 21, as shown in FIG. 2).

In this way, a valance 132 constructed of a fabric outer layer with an inner layer substantially similar to the one or more sound insulating sheet inserts 32 previously described, can further insulate an area behind the sound shielding curtain 22 from an undesired sound source by providing supplemental acoustic insulation over the interface between the sound shielding curtain 22 and the mount 21.

In some applications, one may wish to look through portions of a sound shielding curtain 22. As further illustrated in FIG. 12, the present invention allows for the addition of optically transparent but acoustically hard materials to be integrated with the fabric panel 22 to provide a viewing window 135. If desired, for privacy reasons, any of a number of materials may be further added to shade the viewing window 135. It is apparent that whatever material or configuration of materials is selected may further permit hinging or folding along one or more predetermined lines to permit folding of the sound shielding curtain 22 as previously described in association with other embodiments of the invention.

This feature can be extremely useful in nursing homes where two occupants share the same room. Typically in nursing homes, both occupants are provided with televisions of their own which are mounted across the room from the beds high on an opposing wall. Television audio in institutions of this type is frequently received via a speaker system located near the bed. Currently, if one occupant is viewing and listening to television programming, the other occupant of the room may be disturbed and vice versa. One or more of the sound shielding curtain assembly 130 of FIG. 12 can provide both audio and visual isolation for the room occupants without impairing each occupant's ability to view and listen to television programming when the television monitor is located on the opposite side of the sound shielding curtain assembly 130.

Another important use of the viewing window 135 feature of the sound shielding curtain assembly 130 is that the viewing window 135 may permit a doctor, nurse, or other visitor to observe a patient that desires temporary privacy without disturbing the patient.

In another embodiment of the sound shielding curtain assembly 130 illustrated in FIG. 12, a privacy film, as by way of example but not limited to, 3M Privacy Film, can be integrated into a plurality of the sections of a sound shielding curtain assembly 130 between adjacent hinge portions to create viewing window 135. Viewing window 135 permits the patient or other party seeking privacy to control the transparency of the plurality of "window" panels. In addition, a number of different shade configurations may be placed over the viewing window 135 of the sound shielding curtain assembly 130 on a viewing window by viewing window basis as desired over the length of the curtain. In this way, the sound shielding curtain enables visual privacy of an enclosed area.

It is important to note that an extension 34 as introduced in connection with other embodiments of the sound shielding curtain 20 may be integrated with the sound shielding curtain assembly 130 in order to provide an acoustic barrier that extends from the floor to the ceiling in a room. Extending a sound shielding curtain assembly 130 to surround an undesired noise source may introduce ventilation and air treatment problems particularly in those applications where a sound shielding curtain assembly 130 in contact with both the floor and the ceiling of an area is used to acoustically isolate an apparatus that requires ventilation and or conditioned air to attain nominal operation.

FIG. 12 also illustrates the introduction of one or more ventilation ports 137 into one or more panels of the sound shielding curtain assembly 130. Each of the ventilation ports 137 may be constructed of a fabric outer layer with an inner layer substantially similar to the one or more sound insulating sheet inserts 32 previously described. Ventilation ports 137 can serve to acoustically insulate an area behind the sound shielding curtain 22 while providing for the supply of conditioned fresh air and the evacuation of stale air from an area insufficiently served by a ventilation system.

The one or more ventilation ports 137 may further serve to insulate the sound shielded area from both undesired sound sources and from sounds associated with the movement of air through the ventilation ports 137.

Figure 13A:
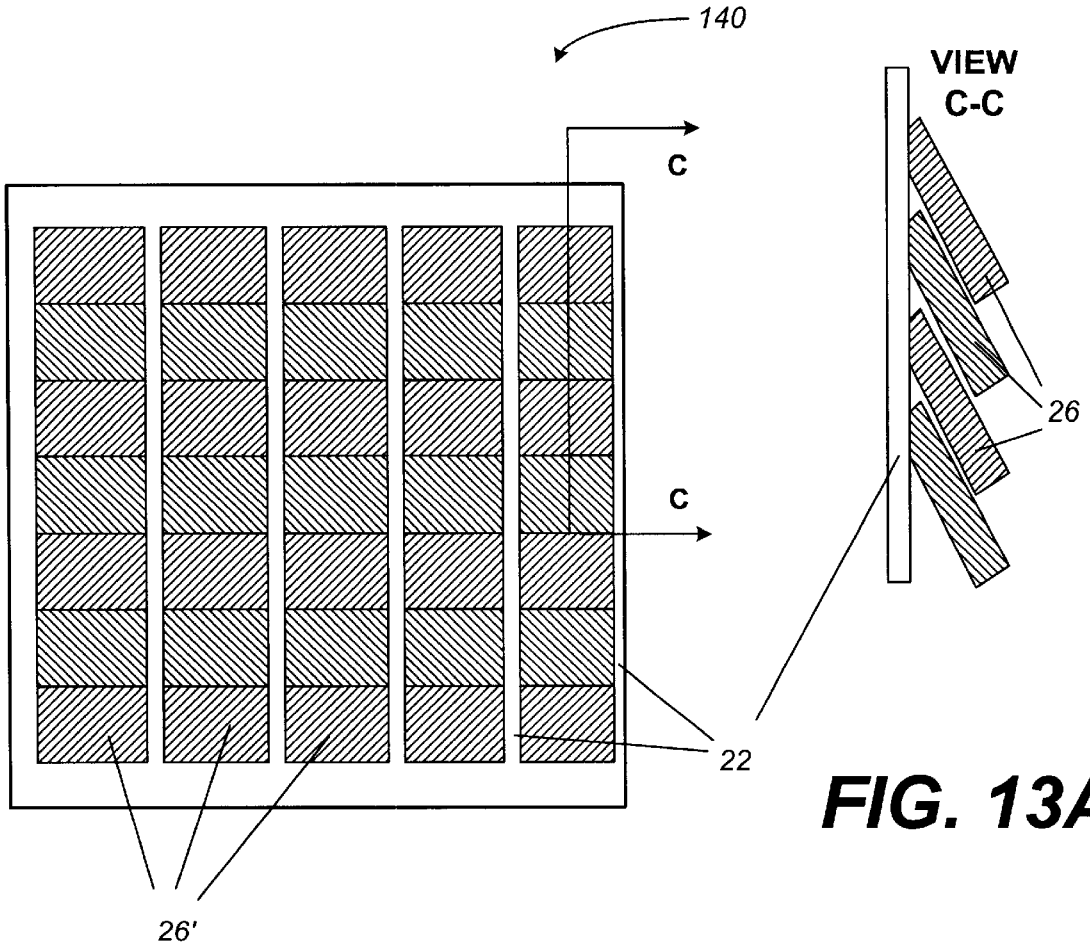
FIG. 13A is a front view of a portion of a sound shielding curtain constructed in accordance with the present invention.
Figure 13B:
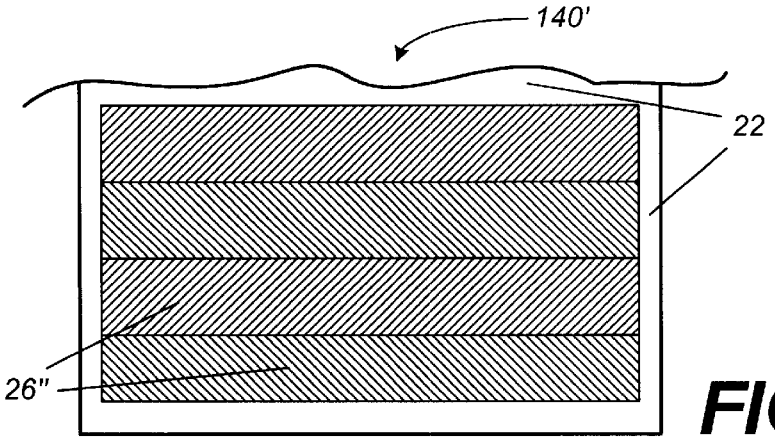
FIG. 13B is a front view of a portion of a sound shielding curtain wherein the pockets are arranged horizontally in a shingle configuration.

Having described the sound shielding curtain assembly 130 illustrated in FIG. 12, reference is now directed to FIGS. 13A and 13B, which illustrate another embodiment of a sound shielding curtain consistent with the present invention. In this regard, FIG. 13A illustrates a front view and a cross-sectional view C—C looking in the direction of lines C—C of a sound shielding curtain assembly 140 in accordance with the present invention.

A sound shielding curtain assembly 140 may be constructed of a fabric panel 22, with a plurality of pockets 26' fixed to the front surface of the fabric panel for closely receiving one or more sound insulating sheet inserts 32 (not shown). As shown in FIG. 13A, and apparent after observing view C—C, after a first pocket 26' is fixed to the front surface of the fabric panel 22 at an angle, whereby a significant portion of the pocket is disposed from contact with fabric panel 22, subsequent pockets 26' take on a shingle arrangement, with a significant portion of each subsequent pocket 26' substantially overlapping the adjacent pocket 26' immediately below.

FIG. 13B illustrates a variation of the shingle arrangement introduced in FIG. 13A. In this regard, FIG. 13A shows a sound shielding curtain assembly 140' constructed of a fabric panel 22, with a plurality of pockets 26" fixed to the front surface of the fabric panel for closely receiving one. or more sound insulating sheet inserts 32 (not shown). However, in the embodiment illustrated in FIG. 13B, each of the plurality of pockets 26" traverses a significant portion of the horizontal length of the fabric panel 22.

Figure 14:
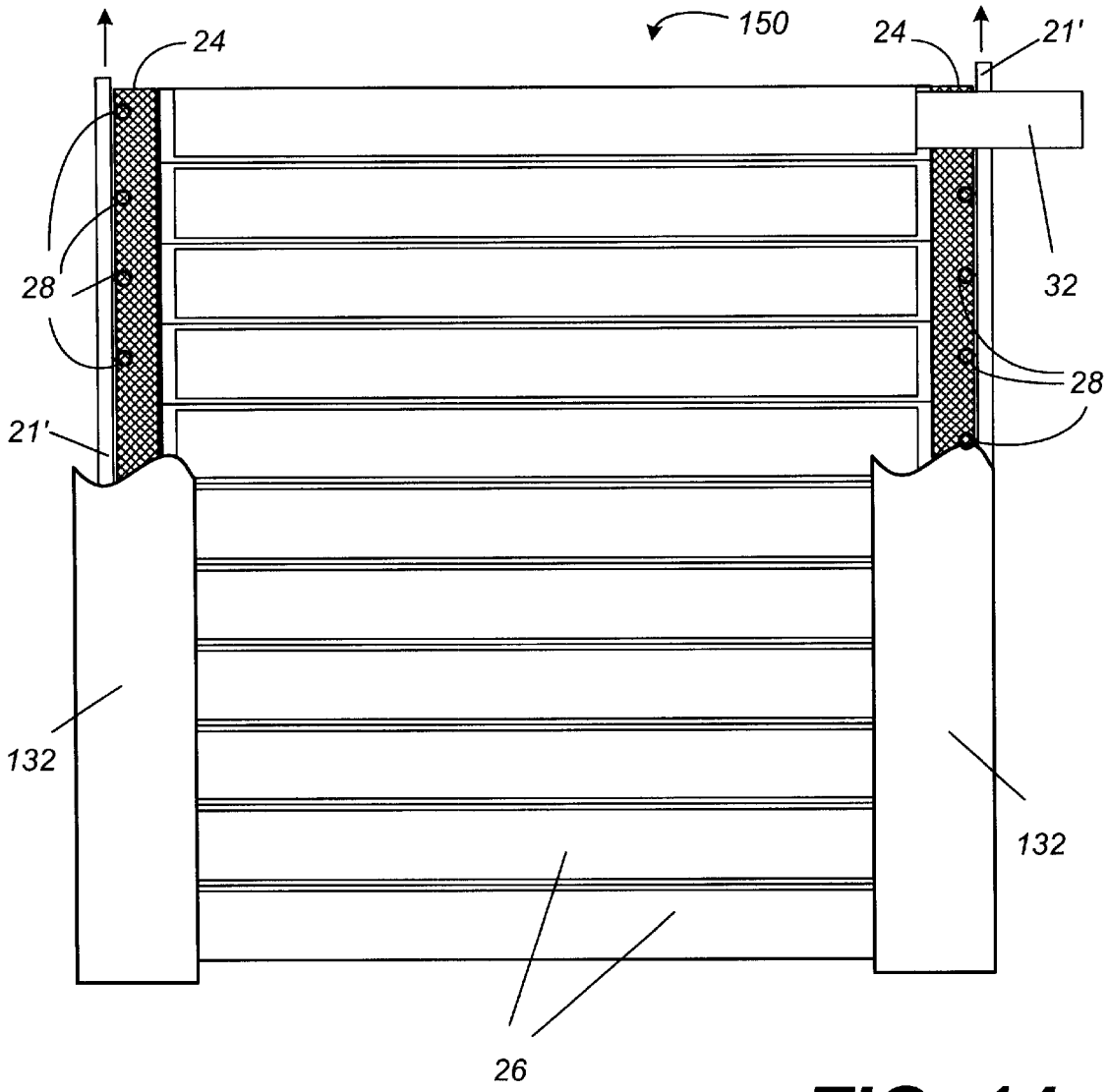
FIG. 14 illustrates a front view of a possible application of a sound shielding curtain consistent with the present invention.

Having described sound shielding curtains 140 and 140' consistent with the present invention as illustrated in FIGS. 13A and 13B, reference is now directed to FIG. 14. In this regard, FIG. 14 reveals a front view of another embodiment of a sound shielding curtain assembly 150 consistent with the present invention. In this regard, a sound shielding curtain assembly 150 as illustrated in FIG. 14 may be mounted at both its left and right sides, both with and without valances 132 placed to overlap the gap in acoustic insulation that may occur at either of the left and right side mounting interfaces. The sound shielding curtain assembly 150 illustrated in FIG. 14 is substantially similar to embodiments previously revealed and described in association with FIGS. 2, 3A, 3B, and 12. Here, the pockets 26 and sound insulating sheet inserts 32 are configured substantially in a horizontal configuration to permit curtain extension by gravity and curtain retraction via coordinated mount 21' from both the left and right sides of the sound shielding curtain assembly 150. Alternatively, the sound shielding curtain assembly 150 may be configured so as to permit retraction as by gravity via mount 21' and curtain extension via coordinated movement between mount 21'. In this regard, FIG. 14 illustrates mesh 24 at both the left and right sides integrated with a plurality of grommets 28 to permit mounting to mount 21'. It is important to note that the mesh 24 interface between the sound shielding curtain assembly 150 and mount 21' is herein illustrated by way of example only. Any of a number of materials including fabric, an extension of the curtain material, or a plurality of panels in accordance with the valance 132 configured to permit the folding and unfolding of the sound shielding curtain as previously described, may be used at the interface between the sound shielding curtain and the mount 21'. The horizontal orientation of pockets 26 and sound insulating sheet inserts 32 as shown in FIG. 14 allow for temporary storage and or reconfiguration of areas by retracting the sound curtains.

Figure 15:
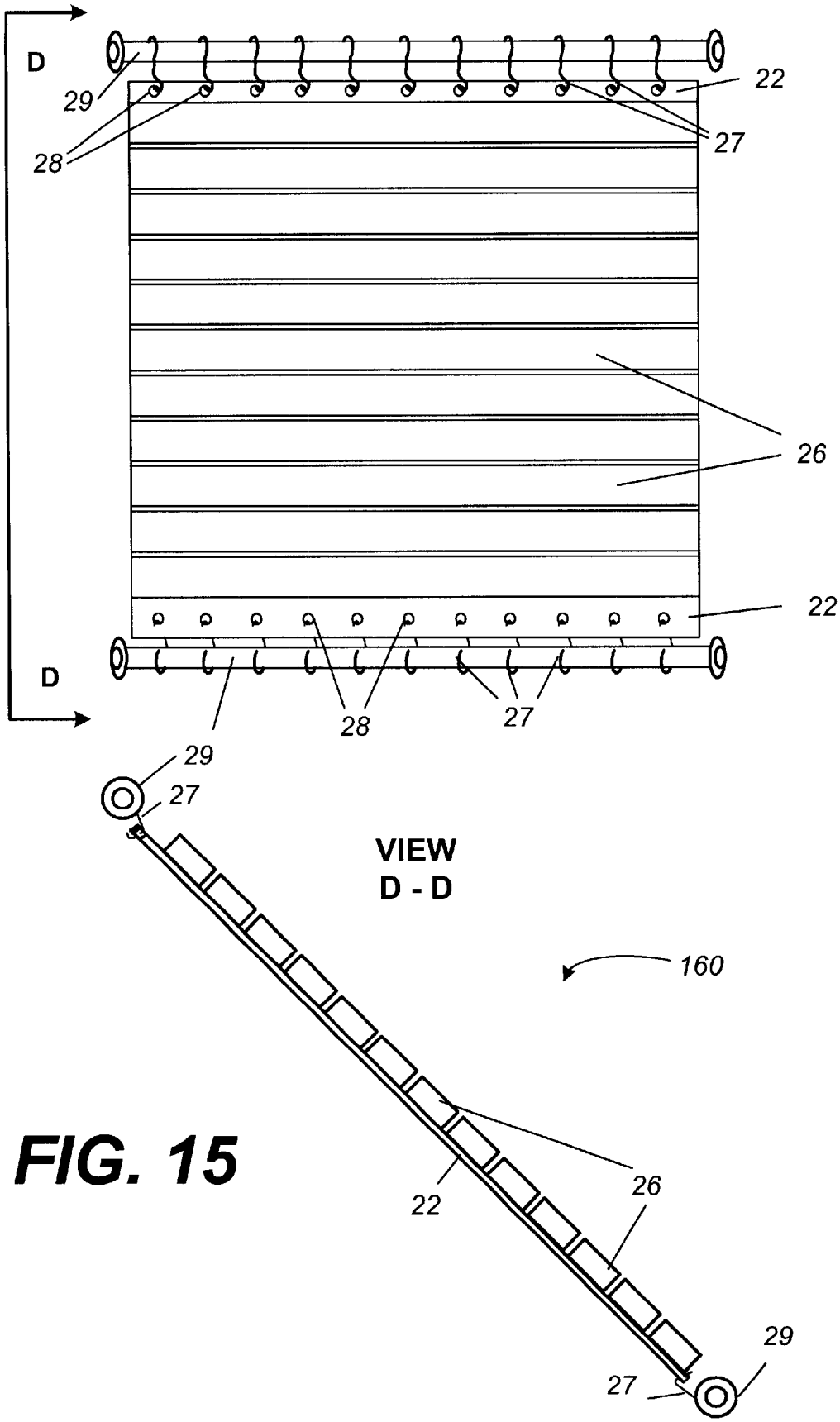
FIG. 15 illustrates both a front view and a side view in the direction of lines D—D of a sound shielding curtain that may be supported within an area such that it is not retractable.

Having described a sound shielding curtain assembly 150 consistent with the present invention as illustrated in FIG. 14, reference is now directed to FIG. 15. In this regard, FIG. 15 reveals a front view of a sound shielding curtain assembly consistent with the present invention that may be mounted in an orientation other than vertical. In this regard, View D—D of FIG. 15 illustrates a side view of a sound shielding curtain assembly 160 that may be mounted along both a top edge and a bottom edge with an orientation other than perpendicular to a floor.

The sound shielding curtain assembly 160 illustrated in FIG. 15 is substantially similar to embodiments previously revealed and described in association with FIGS. 2, 3A, 3B, and 12. The sound shielding curtain assembly 160 may consist of a fabric panel 22, a plurality of pockets 26, a plurality of sound insulating sheets 32 (not shown), mounting rods 19, grommets 28, and hooks 27. Here, however, the pockets 26 and sound insulating sheet inserts 32 are configured substantially in a horizontal configuration and the curtain assembly 160 is not designed to retract or extend. This alternative embodiment of a sound shielding curtain permits the curtain to be suspended in a room at variable distances to insulate sound from undesired overhead sources and or reflected sounds originating from below the sound shielding curtains. It is important to note that it may be more convenient to arrange both the sound shielding curtain 160 and the plurality of pockets 26 in a multiplicity of orientations with the curtain material fixed to mounting rods 29 or other mount (not shown) such that mounting rods 29 together with hooks 27 position the sound shielding curtain other than perpendicular to the floor of an area.

It should be emphasized that the above-described embodiments of the sound shielding curtain and the sound shielding curtain assemblies consistent with the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A sound shielding curtain comprising:

at least one panel of fabric having a first end and a second end, the sound shielding curtain having a frontward facing surface and rearward facing surface, the sound shielding curtain having a plurality of pockets fastened to said curtain on the frontward facing surface, the plurality of pockets configured to receive and support at least one sound insulating sheet constructed of a material that absorbs a range of frequencies; and a plurality of mounting locations for mounting the curtain along said first end of the panel, such that the mount and plurality of pockets with at least one sound insulating sheet permit retraction of the curtain in an accordion fashion, wherein the unretracted curtain acts to insulate an undesired sound from an area bordered by the rearward facing surface of the curtain.

2. The curtain of claim 1, wherein the material used to construct the at least one sound insulating sheet is selected for its ability to reflect a specific range of incident frequencies.

3. The curtain of claim 1, wherein the material used to construct the at least one sound insulating sheet is selected for its ability to absorb a specific range of incident frequencies.

4. The curtain of claim 1, wherein the at least one sound insulating sheet is constructed of a flexible material.

5. The curtain of claim 1, wherein the at least one sound insulating sheet is constructed of a plurality of materials applied in a plurality of layers.

6. The curtain of claim 1, wherein a plurality of pockets are fastened to both the frontward and rearward facing surfaces of said sound shielding curtain, the plurality of pockets configured to receive at least one sound insulating sheet.

7. The curtain of claim 1, wherein the fabric is selected for its ability to absorb a specific range of incident frequencies audible to a human.

8. The curtain of claim 1, wherein the curtain is constructed of a plurality of panels, the panels each configured with a pocket, each of the pockets configured to enclose at least one sound insulating sheet in a removable fashion to permit separate laundering of the fabric from the sound insulating sheets.

9. The curtain of claim 5, wherein the at least one sound insulating sheet comprises an outer layer constructed of a resilient material and an inner layer constructed of a material capable of absorbing a specific range of frequencies.

10. The curtain of claim 8, wherein said pockets are fastened in a removable fashion to the panel to permit separate laundering of the fabric from both the sound insulating sheets and the pockets.

11. The curtain of claim 8, wherein each panel is configured with a plurality of pockets, the pockets configured to enclose at least one sound insulating sheet, after the first pocket proximal to the second end of each of the plurality of curtain panels is fastened to the curtain, the remaining pockets together with the sound insulating sheets are configured in a shingle fashion each pocket overlapping a portion of the pocket below.

12. The curtain of claim 8, wherein the plurality of panels are separable from one another.

13. An apparatus for insulating an area from undesired localized sound sources comprising:

mounting means for introducing a sound shielding curtain, the sound shielding curtain having a frontward facing surface, a rearward facing surface, a first end and a second end, such that when the curtain is mounted along said first end an area is divided into a first sub-area and a second sub-area, the first sub-area subject to an undesired sound, the second sub-area comprising space where it is desired to reduce the magnitude of the undesired sound;

attachment means for attaching a plurality of sound insulating sheets to the frontward facing surface of the sound shielding curtain, the sound insulating sheets and attachment means configured to permit the sound shielding curtain to retract in an accordion fashion, wherein the unretracted curtain acts to insulate an undesired sound from the second sub-area;

first extension means for extending the sound shielding curtain in areas enclosed by a floor, the first extension means configured such that that the sound shielding curtain contacts the upper surface of the floor of the area to further insulate the second sub-area from first sub-area sounds; and a second extension means for overlapping the interface between the sound shielding curtain and said mount in areas enclosed by a ceiling, wherein the second extension means acts to further insulate the second sub-area from first sub-area sounds.

14. The apparatus of claim 13, wherein said first extension means comprises a panel of fabric.

15. The apparatus of claim 13, wherein said second extension comprises a valance constructed in accordance with the sound insulating sheet inserts.

16. The apparatus of claim 13, further comprising:

at least one ventilation port constructed in accordance with the sound insulating sheet inserts.

17. A method for controlling noise in an area comprising the steps of:

providing a mount such that the area is divided into a first sub-area and a second sub-area, the first sub-area subject to an undesired sound, the second sub-area comprising space where it is desired to reduce the magnitude of the undesired sound;

introducing a sound shielding curtain having a first end and a second end, the sound shielding curtain having a frontward facing surface and rearward facing surface, the sound shielding curtain having a plurality of pockets fastened to said curtain on the frontward facing surface, each of the pockets configured to receive at least one sound insulating sheet; and mounting the sound shielding curtain at spaced intervals along the first end such that the sound shielding curtain hangs in a plane substantially perpendicular to said mount the frontward facing surface placed adjacent to the sub-area subject to the undesired sound, the plurality of pockets with at least one sound insulating sheet arranged along with said spaced intervals to permit retraction in an accordion fashion, wherein the unretracted curtain acts to insulate an undesired sound from the second sub-area.

18. The method of claim 17, wherein the sound shielding curtain is constructed of materials selected to absorb a specific range of frequencies.

19. The method of claim 18, wherein the sound shielding curtain is constructed of materials selected to reflect a specific range of frequencies.

20. The method of claim 18, wherein the sound absorbing curtain is constructed of materials selected to absorb a first range of frequencies and reflect a second range of frequencies.

21. The method of claim 18, wherein a plurality of sound shielding curtains are introduced and mounted in a substantially overlapping fashion, wherein at least one of the plurality of sound shielding curtains is constructed of materials selected to absorb a specific range of frequencies and at least one other sound shielding curtain is constructed of materials selected to reflect a specific range of frequencies.

22. The method of claim 18, wherein a plurality of pockets are fastened to both the frontward and rearward facing surfaces of said sound shielding curtain, the plurality of pockets configured to receive at least one sound insulating sheet.

23. The method of claim 18, further comprising the steps of:

inserting a transparent material in a portion of the sound shielding curtain to create a viewing window; and adding a privacy shade operable to cover said viewing window.

24. The method of claim 18, further comprising the steps of:

introducing a sound insulating valance in areas enclosed with a ceiling, sound insulating valance constructed in accordance with the sound insulating sheets; and installing the valance such that it substantially surrounds and overlaps that portion of the sound shielding curtain that interfaces with a mounting surface, the valance configured such that its upper surface remains in contact with the lower surface of the ceiling.

25. The method of claim 24, further comprising the step of:

adding at least one ventilation port constructed in accordance with the valance.

26. The method of claim 18, further comprising the step of:

adding an extension to the sound shielding curtain in areas enclosed by a floor, the extension configured such that the curtain assembly contacts the upper surface of the floor of the area.

27. The method of claim 21, wherein both the first and second frequency ranges are within a third frequency range, the third frequency range characterized by frequencies audible to a human.

28. The method of claim 21, wherein a plurality of sound shielding curtains are introduced and mounted in a substantially overlapping fashion.

29. The method of claim 23, wherein the step of inserting a transparent material in a portion of the sound shielding curtain is performed by inserting a sheet of material with controllable translucence and the step of adding a privacy shade is removed.

* * * * *